US007678951B2

(12) United States Patent
Chretien

(10) Patent No.: US 7,678,951 B2
(45) Date of Patent: Mar. 16, 2010

(54) METHOD FOR ADJUSTING THE HIGH HEATING VALUE OF GAS IN THE LNG CHAIN

(75) Inventor: Denis Chretien, Paris (FR)

(73) Assignee: Total S.A., Courbevoie (FR)

( * ) Notice: Subject to any disclaimer, the term of this patent is extended or adjusted under 35 U.S.C. 154(b) by 379 days.

(21) Appl. No.: 11/601,109

(22) Filed: Nov. 17, 2006

(65) Prior Publication Data

US 2007/0149838 A1 Jun. 28, 2007

(30) Foreign Application Priority Data

Nov. 18, 2005 (FR) ..... 05 11697

(51) Int. Cl.

| | |
|---|---|
| ***C07C 1/04*** | (2006.01) |
| ***F25J 1/00*** | (2006.01) |
| ***C01B 3/02*** | (2006.01) |
| ***C01B 3/24*** | (2006.01) |

(52) U.S. Cl. ..... 585/310; 585/943; 585/314; 585/315; 518/700; 518/702; 62/606; 62/611; 62/620; 423/648.1; 423/651; 48/198.1; 208/78; 208/79; 208/85; 208/95; 208/102

(58) Field of Classification Search ..... 585/943, 585/310, 314, 315; 62/606, 611, 620; 423/651, 423/648.1; 422/188, 189, 190, 197, 229; 48/198.1; 208/78, 79, 85, 92, 93, 95, 100, 208/102, 103; 518/700, 702, 703, 706, 709, 518/712, 713, 714, 715, 717, 726

See application file for complete search history.

(56) References Cited

U.S. PATENT DOCUMENTS

| | | | | |
|---|---|---|---|---|
| 3,361,535 | A * | 1/1968 | Pollitzer et al. | 423/651 |
| 3,387,942 | A * | 6/1968 | Habermehl et al. | 423/437.1 |
| 3,452,548 | A | 7/1969 | Pitaro | |
| 3,456,032 | A | 7/1969 | Kniel | |
| 3,615,164 | A * | 10/1971 | Baker et al. | 252/182.1 |
| 3,656,312 | A * | 4/1972 | Streich | 62/630 |
| 4,070,165 | A * | 1/1978 | Colton | 95/94 |
| 4,098,339 | A * | 7/1978 | Weisz et al. | 166/305.1 |
| 4,130,575 | A * | 12/1978 | Jorn | 518/705 |
| 4,177,202 | A * | 12/1979 | Chang et al. | 518/714 |

(Continued)

FOREIGN PATENT DOCUMENTS

| | | |
|---|---|---|
| BE | 794375 | 7/1973 |
| DE | 2303895 | 8/1973 |
| ES | 364550 | 2/1971 |
| FR | 2004783 | 11/1969 |
| FR | 2169275 | 9/1973 |

(Continued)

OTHER PUBLICATIONS

Search Report, Aug. 24, 2006, Total S.A.

(Continued)

*Primary Examiner*—Walter D Griffin
*Assistant Examiner*—Huy-Tram Nguyen
(74) *Attorney, Agent, or Firm*—Adeli & Tollen LLP

(57) ABSTRACT

The subject of the invention is a method for treating a natural gas containing ethane, comprising the following stages:

(a) extraction of at least one part of the ethane from the natural gas;
(b) reforming of at least one part of the extracted ethane into a synthesis gas;
(c) methanation of the synthesis gas into a methane-rich gas; and
(d) mixing of the methane-rich gas with the natural gas.

Installation for implementing this method.

10 Claims, 5 Drawing Sheets

U.S. PATENT DOCUMENTS

| | | | | |
|---|---|---|---|---|
| 4,285,708 | A * | 8/1981 | Politte et al. | 62/630 |
| 4,421,535 | A * | 12/1983 | Mehra | 62/625 |
| 4,897,098 | A * | 1/1990 | Pate et al. | 62/630 |
| 4,979,966 | A * | 12/1990 | Rojey et al. | 95/174 |
| 6,125,653 | A * | 10/2000 | Shu et al. | 62/622 |
| 6,739,125 | B1 * | 5/2004 | Mulligan | 60/286 |
| 2004/0018144 | A1 * | 1/2004 | Briscoe | 423/652 |
| 2004/0079107 | A1 * | 4/2004 | Wilkinson et al. | 62/611 |
| 2004/0248999 | A1 * | 12/2004 | Briscoe et al. | 518/703 |
| 2005/0155381 | A1 * | 7/2005 | Yang et al. | 62/620 |
| 2005/0205468 | A1 * | 9/2005 | Cadours et al. | 208/189 |
| 2006/0135630 | A1 * | 6/2006 | Bowe | 518/702 |
| 2006/0277943 | A1 * | 12/2006 | Yokohata et al. | 62/620 |
| 2007/0049647 | A1 * | 3/2007 | Van Egmond et al. | 518/702 |
| 2008/0016910 | A1 * | 1/2008 | Brostow et al. | 62/630 |

FOREIGN PATENT DOCUMENTS

| | | |
|---|---|---|
| GB | 1261457 | 1/1972 |
| GB | 1413287 | 11/1975 |
| IT | 978476 | 9/1974 |
| JP | 48086904 | 11/1973 |
| JP | 48042921 | 12/1973 |
| NL | 7301079 | 7/1973 |

OTHER PUBLICATIONS

Huang S., et al., "Select The Optimum Extraction Method for LNG Regasification Varying Energy Compositions of LNG Imports May Require Terminal Operators to Remove C2+ Compounds Before Injecting Regasified LNG into Pipelines" Hydrocarbon Processing, Gulf Publishing Co. Houston, US, vol. 83, Jul. 2004, pp. 57-62, XP009038899 ISSN: 0018-8190.

Yang C., et al., "Cost-Effective Design Reduces C2 and C3 at LNG Receiving Terminals" Oil and Gas Journal, Pennwell, Houston, TX, US May 26, 2003, pp. 50-53, XP009044374, ISSN: 0030-1388.

British Gas Corporation International Consultancy Service, "Gasification Processes", Kelly & Kelly Ltd., London, Month N/A, 1976.

* cited by examiner

METHOD FOR ADJUSTING THE HIGH HEATING VALUE OF GAS IN THE LNG CHAIN

TECHNICAL FIELD

A subject of the invention is a new method for adjusting the high heating value of gas in the LNG chain.

STATE OF THE ART

Natural gas is essentially used as a fuel in boiler burners, in gas turbines for the production of electricity or, more simply, in domestic cookers. All these pieces of equipment must be able to burn gas in a safe and reliable manner. It is therefore essential that the combustion characteristics of this gas are constant in order to be compatible in a long-lasting manner with the user's equipment.

One of the main properties of gas required for defining burners is its high heating value (HHV). This is the amount of heat released during combustion. It is measured in kcal/$Nm^3$ or, in imperial units, in BTU/scf.

One of the sources for supplying gas to consumer countries is Liquefied Natural Gas (LNG) produced from gas fields by liquefaction plants. Their main outlets are currently the Far Eastern countries, principally Japan, South Korea and Taiwan. These countries have in common the use of gases the HHV of which is high (of the order of 1150 to 1250 BTU/scf). The United States and the United Kingdom have been significant importers of LNG for some years and a sharp increase in their demand can be envisaged in the coming years. In both these countries the networks distribute natural gases the HHV of which is markedly lower than that of the traditional importing countries. A complete review is proposed in "Differing market quality specs challenge LNG producers", Y. Bramoullé, P. Morin, J. P. Capelle (Total) Oil and Gas Journal, 11 Oct. 2004.

Natural gas is a mixture of hydrocarbons principally comprising methane, ethane, propane, butane and some traces of heavier hydrocarbons. These constituents do not all have the same HHV so that the HHV of the gas depends on its composition. The HHV of a hydrocarbon is a function of the length of its carbon chain; the longer the chain, the higher the HHV. By contrast a non-fuel gas has a nil HHV. A natural gas consequently has a higher HHV as its content of heavy hydrocarbons increases.

There are thus two methods for reducing the HHV value of a gas: (1) the injection of a ballast gas, in particular nitrogen, the calorific contribution of which is nil and (2) the extraction of the heaviest hydrocarbons which have the greatest calorific contribution.

The injection of nitrogen is commonly used in LNG receiving terminals but the maximum nitrogen content is limited in the networks. As a result, for certain gases, the injection of nitrogen is insufficient since the maximum acceptable nitrogen content is reached before the HHV of the gas is sufficiently reduced. Therefore the injection of nitrogen is not a promising option.

The extraction of the heavy constituents has led to a significant number of patents and publications.

The document "Select optimum extraction method for LNG regasification", S. Huang, D. Coyle, J. Cho and C. Durr, Hydrocarbon Processing, July 2004, describes the different methods for extraction of heavy constituents at the LNG receiving terminals.

U.S. Pat. No. 6,564,579 proposes a method for extracting the heaviest constituents from LNG, including an ethane fraction, at the receiving terminals.

The document "Cost effective design reduces C2 and C3 at LNG terminals", Oil and Gas Journal, May 2003 proposes two methods for extracting respectively ethane and propane from LNG.

However it appears that the specifications of gases in the United States and in the United Kingdom are so low that the extraction of propane often proves to be insufficient and that the extraction of a part of the ethane is also necessary. Whereas propane is a commercial product the sale of which is simple and profitable, ethane is a product principally intended for the petrochemical industry for which an outlet near the site where it is extracted does not necessarily exist.

The drawback of all the methods for extraction of the above-mentioned heavy compounds is that they do not propose a use for the extracted ethane.

The company Davy Process proposes, under licence from Johnson Matthey Catalyst, a method for chemical conversion of heavy hydrocarbons to methane allowing the HHV of the gas to be reduced but without the co-production of ethane. This method is described briefly in the annual statement "Gas Processes 2004" in the journal Hydrocarbon Processing.

A need therefore exists for an economical method integrated into the production chain of gas, in particular LNG, for reducing the HHV of gas, said method proposing a use for the extracted ethane.

SUMMARY OF THE INVENTION

A subject of the invention is a method for treating a natural gas containing ethane, comprising the following stages:

(a) extraction of at least one part of the ethane from the natural gas;

(b) reforming of at least one part of the extracted ethane into a synthesis gas;

(c) methanation of the synthesis gas to a methane-rich gas; and (d) mixing of the methane-rich gas with natural gas.

According to a first variant, the method also comprises stage (a1) of deacidification and drying of the natural gas before stage (a); and stage (a) is carried out on sweetened and dried natural gas; and stage (d) of mixing is carried out before stage (a1).

According to one embodiment, the method also comprises a stage of reforming and methanation on a part of the natural gas before stage (a).

According to one embodiment, the method also comprises the use of a part of the extracted ethane as a fuel gas, for example up to 70%.

According to one embodiment, the method also comprises stage of liquefaction of the gas.

According to a second variant stage (a) is carried out on sweetened and dried natural gas; and the method also comprises a stage of drying the methane-rich gas before stage (d).

According to one embodiment, in the method the sweetened and dried natural gas is available in liquefied form.

According to one embodiment, in the method the methanation stage produces heat which is used to partially vaporize the gas in liquefied form.

The method according to the invention can comprise the stage of separating the heavy components from said gas into a light fraction and a fraction of heavier components containing ethane and LPGs.

According to one embodiment, the method also comprises the stage of fractionating the heavier components into at least one stream containing ethane and LPG streams.

The method according to the invention is suitable for the high heating adjustment of said gas.

A subject of the invention is also an installation for implementing the method according to the invention.

Thus a subject of the invention is also an installation for treating a natural gas containing ethane in a feed line, comprising the following elements:

(i) a column for extraction of at least one part of the ethane from the natural gas;

(ii) a reactor for reforming said part of the extracted ethane into a synthesis gas;

(iii) a reactor for methanation of the synthesis gas to a methane-rich gas which is connected to said reforming reactor; and (iv) a mixer for the methane-rich gas and the natural gas.

According to a first variant, the installation also comprises units for deacidification and drying of the natural gas upstream of the extraction column; the mixer being situated upstream of said deacidification and drying units.

According to one embodiment, the reforming and methanation reactors are partly installed on the gas feed line.

According to one embodiment, the installation comprises turbines for producing energy partly fed with a part of the extracted ethane.

According to one embodiment, the installation also comprises a unit for liquefaction of the gas.

According to a second variant, the installation comprises a feed of sweetened and dried natural gas; and a device for drying the methane-rich gas upstream of the mixer.

According to one embodiment, the feed is a feed of gas in liquefied form.

According to one embodiment, the installation comprises a heat exchanger between the liquefied gas line and the methanation reactor.

The installation can comprise a column for separating into a light fraction and a fraction of heavier components containing ethane and LPGs.

According to one embodiment, the installation also comprises a unit for fractionating the heavier components into at least one stream containing ethane and LPG streams.

Another subject of the invention is a method for liquefying a natural gas containing ethane, comprising the following steps:

deacidification and drying of the natural gas;

precooling of the sweetened and dried natural gas;

extraction of at least one part of the ethane from the precooled natural gas to produce a high-ethane fraction and a low-ethane fraction;

cooling and liquefying of the low-ethane fraction;

separation of the high-ethane fraction into a high-ethane cut and a high-propane, butane and condensates cut;

reforming of at least one part of the high-ethane cut into a synthesis gas;

methanation of the synthesis gas into a methane-rich gas;

mixing of the methane-rich gas with the natural gas before deacidification and drying.

The invention proposes an effective integration into the LNG chain of the chemical conversion of hydrocarbons heavier than methane, in particular of ethane, contained in the natural gas in order to reduce the HHV.

The subject of the present invention is therefore to propose an economical method integrated into the gas chain, in particular LNG. The integration can take place both in liquefaction plants and in the receiving terminals. Although LNG is the field of application most suited to the invention, the latter can also advantageously be used in the treatment of gas, in particular in extraction plants for Liquefied Petroleum Gases (LPG) where it is sought to produce a leaner gas than that which is produced during the simple extraction of LPGs. The invention therefore also applies both to natural gas liquefaction plants and to receiving terminals for natural gas. It also applies to LPG extraction plants.

DETAILED DESCRIPTION OF EMBODIMENTS OF THE INVENTION

Figure 1:
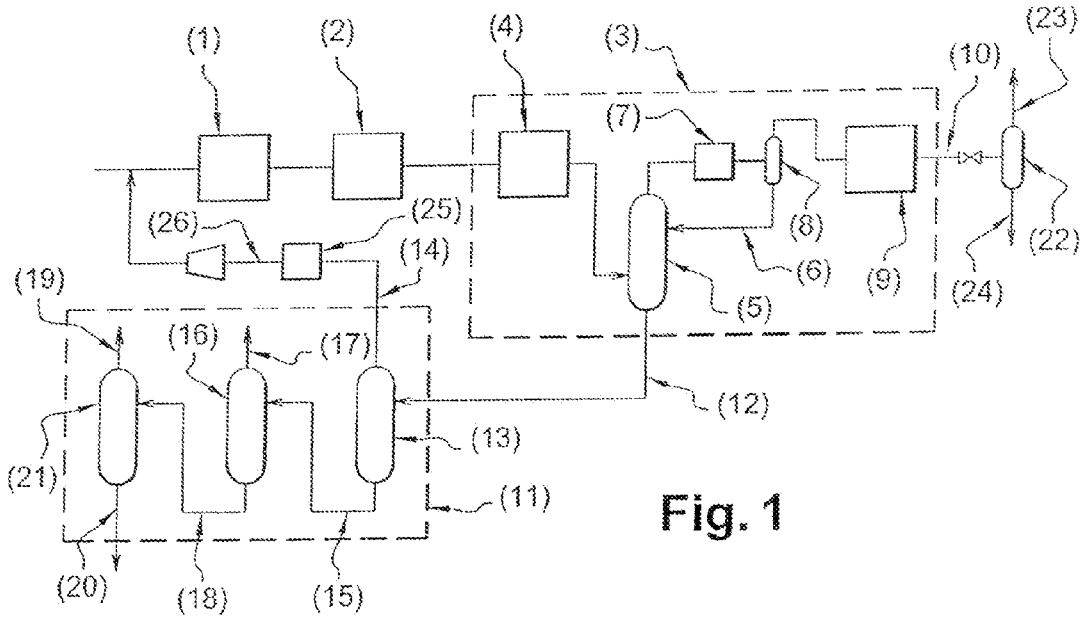
FIG. 1 shows the integration of the ethane conversion in a natural gas liquefaction plant.

The description concerning the liquefaction plants is given with reference to FIG. 1. The gas to be liquefied most often contains acid gases ($CO_2$ and $H_2S$) which are removed from the gas in a deacidification unit (1), which can be based on the use of aqueous amine solutions. The gas is then dried in (2) in order to prevent the crystallization of the water in the cryogenic equipment. The gas then enters the cryogenic section (3) (shown by a dotted line). It is firstly pre-cooled in (4) to a temperature usually comprised between −20° C. and −40° C. The gas is then introduced into a column (5) usually called a "scrubb column" where the heavy constituents of the gas are washed by the reflux (6). The top gas is cooled further in (7) and partially condensed. The gas and the vapour are separated in the reflux drum (8). The liquid (6) is used for reflux in the column (5) and the gas is introduced into the exchanger (9) where it is liquefied. The LNG produced (10) is firstly expanded at low pressure in (22). It is separated into a liquid phase (24) and a vapour phase (23) in the separator (22). This last vapour phase, after recompression, is used as a fuel gas in the plant for which it provides the energy. The LNG in the liquid product state at (24) is sent to the storage tanks.

The function of the "scrubb column" (5) is principally to remove from the gas the heavy constituents such as benzene or cyclohexane the crystallization points of which are high and the solubility in LNG is low. The heaviest constituents of the gas are collected in liquid form in the tank of the column (5). Besides benzene, other constituents are entrained including LPGs (propane and butane), the condensates corresponding to the C5+ cut as well as a fraction of the ethane contained in the gas and dissolved methane. The fraction of extracted ethane is larger the lower the temperature of the reflux drum (8).

The extracted products are valorizable and are separated in the fractionation unit (11) (shown by the dotted lines) in order to be sold separately. Several arrangements of the fractionation columns exist and the simplest one is represented here, however the variants are easily accessible for a person skilled in the art. The liquids (12) originating from the column (5) are introduced into a column (13) called a deethanizer. From its head an ethane-rich cut (14) is extracted. This cut also substantially contains all of the methane dissolved in the liquid (12). In the tank a C3+ cut (15) is produced containing propane and all the products heavier than propane. This mixture (15) is introduced into the depropanizer (16) from which the propane (17) is removed at the head and a C4+ cut (18) at the tank. Finally, the latter is separated into commercial butane (19) and condensates (20) in the debutanizer (21). The separated products originating from the fractionation unit, namely propane (17), butane (19) and the condensates (20) are routed to their respective storage tanks before they are sold.

Since it is rare that the ethane-rich stream (14) has a valorization close to the liquefaction plant, it is generally compressed and re-injected into the natural gas with which it is liquefied.

The LNG plants consume large amounts of power and ethane can also be mixed with the fuel gas (23) for a local use. However the gas turbines used in the LNG plants can only accept a limited ethane content in the fuel gas, of the order of 15% volume. When the ethane is mixed with the fuel gas, this value is most often exceeded and this outlet is necessarily restricted.

The invention proposes chemical conversion of the ethane contained in the methane stream (14). For this purpose, the stream (14) is introduced into a conversion unit (25) where most of the ethane is converted to methane. Thus a lean gas is produced which can be mixed with natural gas without increasing its HHV. In addition, the gas produced being essentially methane, it is leaner than the natural gas at the inlet of the plant and contributes by mixing to an overall reduction of the HHV of LNG.

The unit (25) can, in certain cases, lead to secondary chemical reactions which produce by-products, principally carbon dioxide and water. Because these two constituents are liable to crystallize in the cryogenic section of the plant, the stream (26) is, after compression, mixed with the natural gas at the inlet of the plant in a mixer which can be for example a mixing valve. The thus added carbon dioxide is extracted together with that of the natural gas in the deacidification unit (1) then the added water is extracted in the drying unit (2).

According to a variant, the method for conversion of hydrocarbons to methane and more particularly of ethane to methane principally comprises two stages in series.

In a first reactor, the heaviest hydrocarbons are (catalytically) reformed as vapour in a mixture of hydrogen ($H_2$) and carbon monoxide (CO) called synthesis gas. In a second reactor, the $H_2$/CO mixture is converted to methane on catalyst.

The reforming reaction is generally written as:

$$HC+H_2O \rightarrow H_2+CO \quad \text{(R1)}$$

For example for ethane it is:

$$C_2H_6+2H_2O \rightarrow 5H_2+2CO$$

This reaction is endothermic.

The methanation reaction is written as:

$$2H_2+2CO \rightarrow CH_4+CO_2 \quad \text{(R2)}$$

This reaction is exothermic.

In this conversion method, the heat released by the methanation reaction is used for the steam reforming reaction. However the thermal equilibrium is not attained and more heat is supplied.

The overall balance is written in the following way for the first hydrocarbons:

Ethane $$4C_2H_6+9H_2O \rightarrow 7CH_4+7H_2O+CO_2$$

Propane $$2C_3H_8+7H_2O \rightarrow 5CH_4+5H_2+CO_2$$

Butane $$4C_4H_{10}+19H_2O \rightarrow 13CH_4+13H_2O+CO_2$$

It is seen that the carbon efficiency of the reaction decreases as the carbon number of the converted hydrocarbon molecule increases. According to one embodiment, only the ethane fraction will be converted and the butane and propane cuts will be retained. The stream at the head of the deethanization column where the ethane is concentrated is therefore that which, converted, has the best carbon efficiency of the method.

Figure 2:
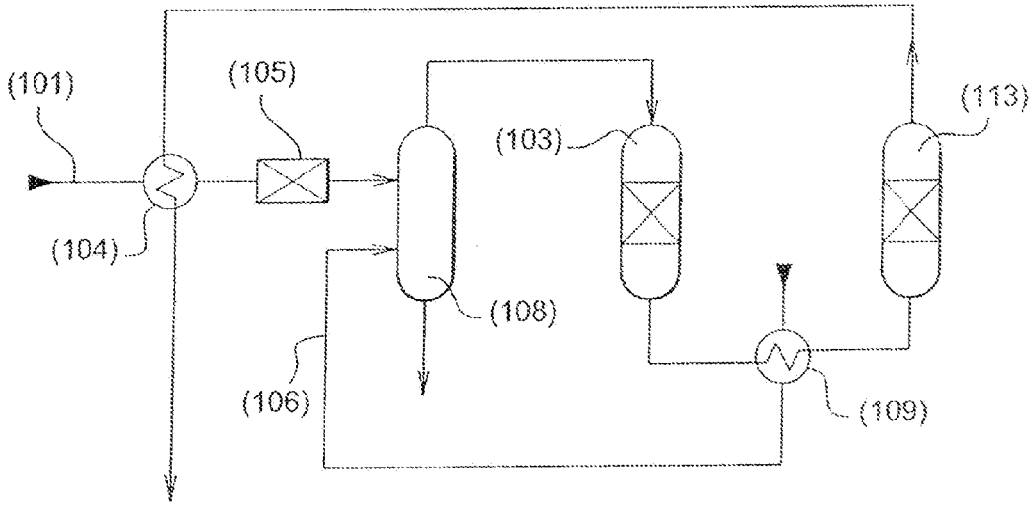
FIG. 2 shows a detailed view of the ethane conversion unit.

The method can be followed in a more detailed manner with the help of FIG. 2. The feed gas (101) contains methane and the heaviest hydrocarbons which will be converted, principally ethane in the case of the invention. The feed gas (101) is pre-heated at (104) to the temperature required for desulphuration (105). The desulphuration phase is preferred because the catalysts situated downstream are generally sensitive to the sulphurated products. The desulphurated gas is mixed with steam (106), heated to a temperature of the order of 375° C. in a saturator (108) equipped with a water drain. This gas containing water (generally this gas is saturated with water) is then introduced into the reactor (103). This reactor (103) is the Catalytic Rich Gas (CRG) reactor where the selective reforming reaction of the hydrocarbons heavier than methane according to reaction R1 to a synthesis gas takes place. The hot gas is cooled in (109) where the heat available in the gas is used in order to produce steam which is sent by (106) to the saturator (108). The cooled gas can optionally be separated in two. In this case, one part is cooled before being recycled by a compressor to the feed gas. This part serves as a diluent for the feed gas, if desired. The cooled gas or one part thereof is introduced into the methanation reactor (113) where the synthesis gas reacts according to the reaction R2. The gas produced is then cooled for example in the exchanger (104) in order to pre-heat the feed gas and/or in order to produce steam which can be used in the CRG.

At the end of this procedure, the heavy hydrocarbons present in the gas (101) were selectively converted to methane by catalytic route.

The by-products of the conversion ($H_2O$ and $CO_2$) which are incompatible with the subsequent cryogenic treatment of the gas are eliminated in the deacidification unit (1) for the carbon dioxide and in the drying unit (2) for the water.

Thus the conversion unit is integrated naturally into a liquefaction method for natural gas.

Figure 3:
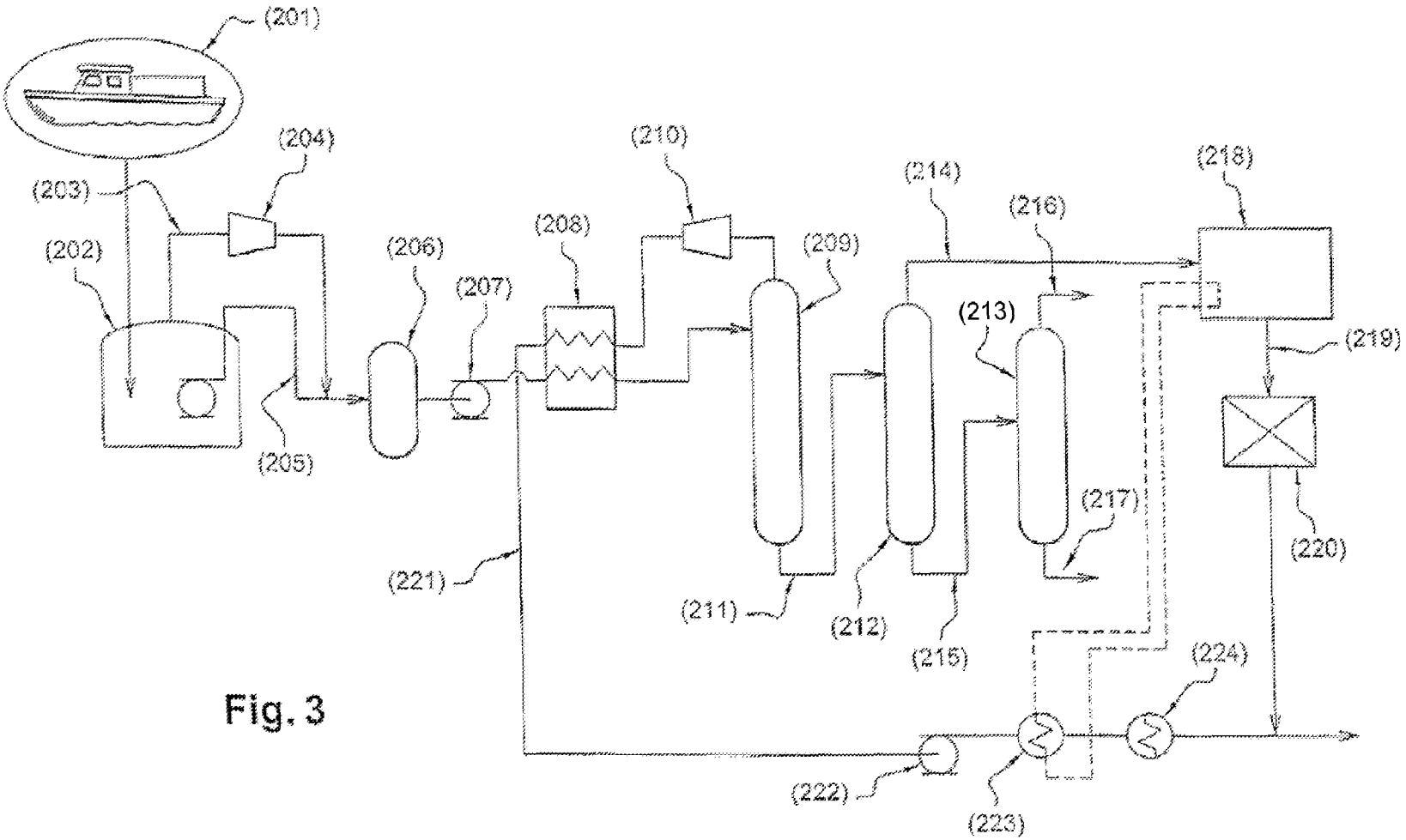
FIG. 3 shows the integration of the ethane conversion in a natural gas receiving terminal.

However, the invention also applies to LNG receiving terminals in which the conversion unit can also be very effectively integrated. The description of the invention in the case of methane terminals is based on FIG. 3.

The liquefied gas is unloaded from the LNG tanker (201) and stored in the storage tanks (202). The vapours from tanks (203) after compression in the compressor (204) and the LNG (205) are remixed in the reliquifier (206). The mixture is pumped at high pressure (of the order of 20 to 35 bars) by the pumps (207) and partially vaporized in the exchanger (208). The mixture is introduced at the head of the column (209). The vapours at the head of the column (209) are compressed in the compressor (210) and liquefied by cold recovery of the LNG in order to provide a stream of liquefied gas (221). The liquid in the tank (211) of the column (209) contains the C2+ cut of the LNG. It is separated into its different constituents in a series of fractionation columns (212) and (213). The deethanization column (212) separates the ethane (214) at the head of the C3+ cut (215) into the tank. The latter is again distilled into a valorizable propane cut (216) and a C4+ cut (217). A last column, which is not shown, would allow the butane to be separated from the condensates if necessary.

The ethane stream (214) is routed towards the conversion unit (218) similar to that already described for the liquefaction unit. A methane-rich gas (219) is extracted from it in which the ethane was converted to methane. This gas contains the same by-products as in the case of the liquidation plant, namely carbon dioxide and water. The carbon dioxide content obtained is generally lower than that which is tolerated in the networks fed by the LNG terminals so that, by contrast to the liquefaction plants, it is not necessary to provide deacidification. Moreover carbon dioxide is inert which contributes to the reduction of the heating value of the gas. However the water is generally eliminated in (220) as its content in the gas produced would exceed that of the latest specifications. In order to do this, it is possible to use a glycol drying unit.

The liquefied gas (221) is pumped to the pressure of the network (or typically from 40 to 120 bar) in (222) and vaporized. The vaporization of LNG requires significant quantities of heat, the provision of which has an operating cost. The conversion unit in turn provides a residual heat which can be used in (223) in order to contribute in an economical way to the vaporization of LNG. Most of the heat supply however takes place in (224) by means of standard techniques for sea water vaporizers or by means of submerged flame vaporizers.

The conversion of ethane is therefore integrated just as well in a receiving terminal as in a liquefaction plant.

Although the best location is found on the head stream of the deethanization column, its is possible to place the treatment unit on one part of the feed stream.

The location on the head stream of the deethanizer has several advantages in both cases. Firstly, the head stream of the deethanizer is the one in which the ethane is most concentrated. Consequently, it is the treatment of this stream which leads to the smallest conversion unit. By way of comparison, if the conversion unit was located on one part of the feed stream (101) of the liquefaction plant, its flow rate would have to be almost three times greater than that of the invention due to the greater dilution of the ethane. Moreover, such a location would also convert the LPGs. The LPGs, essentially propane and butane are products which can be easily valorized anywhere while the ethane market is restricted to the petrochemical area of activities. It is therefore advantageous to convert as much ethane as possible and as little LPG as possible. Since the head stream of the deethanization column is a virtually free of LPG, its treatment makes it possible to prevent the conversion of LPG and to convert only the ethane. However, other embodiments are possible in which the treatment does not necessarily take place only on the head stream of the deethanizer.

Figure 4:
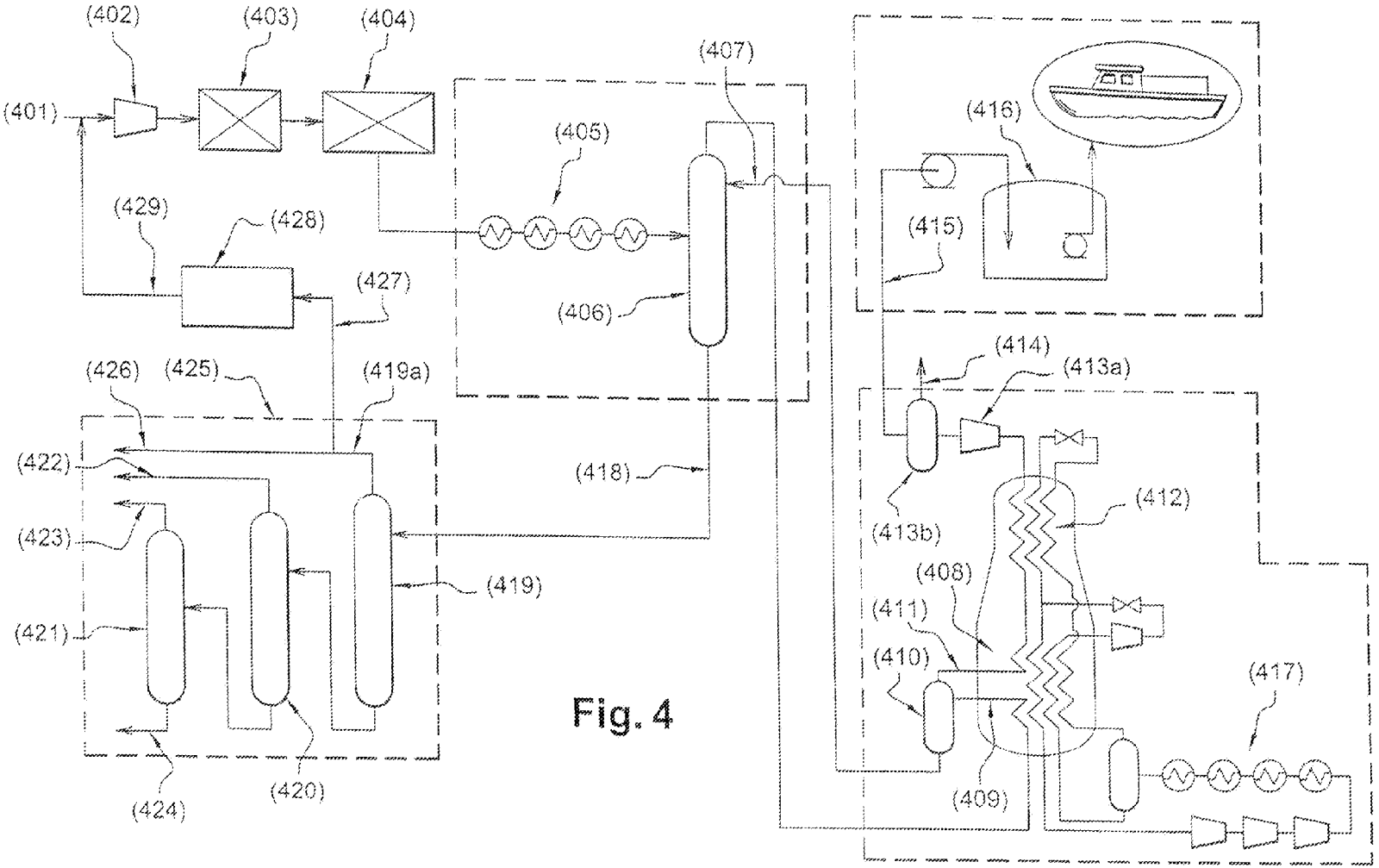
FIG. 4 shows an embodiment of the integration of the ethane conversion in a natural gas liquefaction plant.

FIG. 4 represents an example of a natural gas liquefaction plant.

The feed gas (401) is available at 43 bar and has the composition shown in Table 1.

TABLE 1

| Constituent | Molar composition in % |
|---|---|
| $CO_2$ | 1.85 |
| $N_2$ | 1.18 |
| $CH_4$ | 84.27 |
| $C_2H_6$ | 10.19 |
| $C_3H_8$ | 2.15 |
| $iC_4H_{10}$ | 0.14 |
| $nC_4H_{10}$ | 0.19 |
| $iC_5H_{12}$ | 0.02 |
| $nC_5H_{12}$ | 0.01 |

The flow rate of gas is 31417 kmol/h.

The LNG is intended for one of the countries which requires a low HHV and the composition must be, for example, that shown in Table 2:

TABLE 2

| Constituent | Molar composition in % |
|---|---|
| $N_2$ | 0.42 |
| $CH_4$ | 91 |
| $C_2H_6$ | 8.5 |
| $C_3H_8$ | 0.08 |

It is noted that ethane which represents 12.1% of the methane in the feed gas represents no more than 9.3% of the methane in the final LNG. It is therefore necessary to carry out a partial extraction of ethane then its elimination assuming that there is not commercial outlet nearby. In order to do this the invention is carried out as illustrated by way of example in FIG. 4.

The gas is firstly compressed to 50 bar in the compressor (402). The presence of carbon dioxide involves decarbonation in the amine washing unit (403). The wet gas from (403) is dried, for example on a molecular sieve in the unit (404). The gas is then cooled to a temperature of −35° C. by a refrigeration unit (405), for example a four-stage propane chiller. The partially condensed gas is introduced into the column (406) where the heavy constituents are condensed and washed under reflux (407). The top gas of the column is cooled further in the exchanger (408). It leaves the exchanger at (409) at a temperature of −64° C. The condensed liquid is separated from the gas in the reflux drum (410) and sent as reflux (407) to the column (406). The purified gas (411) is reintroduced into the exchanger (408) where it is liquefied at a temperature of −157° C. at (412). It is then expanded firstly in a hydraulic turbine (413*a*) then in a valve (not shown) to the flash drum (413*b*) where the liquid-vapour equilibrium is established at 1.3 bar and −160.4°. After reheating and compression, the gas (414) is used as fuel gas (or FG) in the gas turbines driving the cycle compressors. The LNG (415) is routed to the storage tanks (416). The liquefaction of the gas is obtained by cooling to −157° C. using a multi-component refrigeration cycle diagrammatically represented in (417).

The liquid (418) originating from the column (406) contains approximately 25% of the ethane contained in the feed gas (401). This liquid is introduced into the deethanization column (419). The ethane contained in the stream (418) and the methane dissolved in the stream (418) are collected at the head of the column (419) via the line (419*a*).

The propane, butane and the condensates contained in (418) are once again in the stream at the tank of the column (419) and are then separated in the depropanization (420) and debutanization (421) columns. A stream of 652 kmol/h of commercial propane is produced at (422), i.e. a recovery of 95% of the propane entering. More than 98% of the butane entering with the feed gas is recovered at (423), i.e. approximately 102 kmol/h. Finally all of the condensates are produced at (424), i.e. approximately 9 kmol/h.

The group of columns (419), (420) and (421) constitutes the fractionation unit (425), represented in dotted lines on the figure.

A fraction of the ethane-rich stream (419 *a*) at the head of column (419) is routed at (426) towards the plant's fuel gas system. Its flow rate of 617 kmol/h is limited by the quantity of ethane tolerated by the gas turbines where it will be burned. The remainder (427), i.e. approximately 1120 kmol/h, is routed towards the conversion unit (428) in order to undergo there the steam reforming and methanation operations.

The gas (429) originating from the conversion unit has a flow rate of 1637 kmol/h and has the following composition according to Table 3:

TABLE 3

| Constituent | Molar composition in % |
|---|---|
| $CO_2$ | 7.9 |
| $N_2$ | 0.1 |
| $CH_4$ | 92 |
| $C_2H_6$ | 0 |

This gas stream (429) is also saturated with water. It is noted that the ethane has been completely converted. This gas stream (429) is mixed with the feed gas (401): together they are then decarbonized and dried respectively in units (403) and (404). (The presence of water and carbon dioxide in the stream (429) makes it unsuited to direct cryogenic liquefaction treatments).

It will be noted that if the ethane had not been converted and in the absence of a commercial outlet it would have been necessary to use it as fuel gas in gas turbines. Besides the difficulty which has already been mentioned of burning gases with a high ethane content in these turbines, there is another drawback in using ethane as a fuel. Fuel gas from the plant is produced by expanding the LNG (412) at the cold end of the exchanger (408). It may seem paradoxical to produce the fuel gas at low pressure and to compress it to the operating pressure in gas turbines of the order of 25 to 35 bar when natural gas is available at high pressure. However this method results from an optimization. The quantity of fuel gas of the stream (414) depends on the temperature of the stream (412): the higher it is the greater the quantity of flashed gas and the less the refrigeration cycle is required. The overall balance shows that it is more advantageous to produce the LNG (412) at a higher temperature and that the compression energy of the fuel gas (414) is more than compensated for by the saving made in the cycle (417). If the ethane produced in (425) is used as fuel gas, the quantity of gas required at (414) is reduced by the same amount, which reduction requires the production of the stream (412) at a lower temperature. This procedure conflicts with the optimization described previously. The conversion of the ethane contained in (425) therefore makes it possible to prevent its use as a fuel gas. The flow rate of (414) is thus increased so as to satisfy as much as possible the requirements of the plant in the context of the optimization described above and the overall energy balance is improved.

Figure 5:
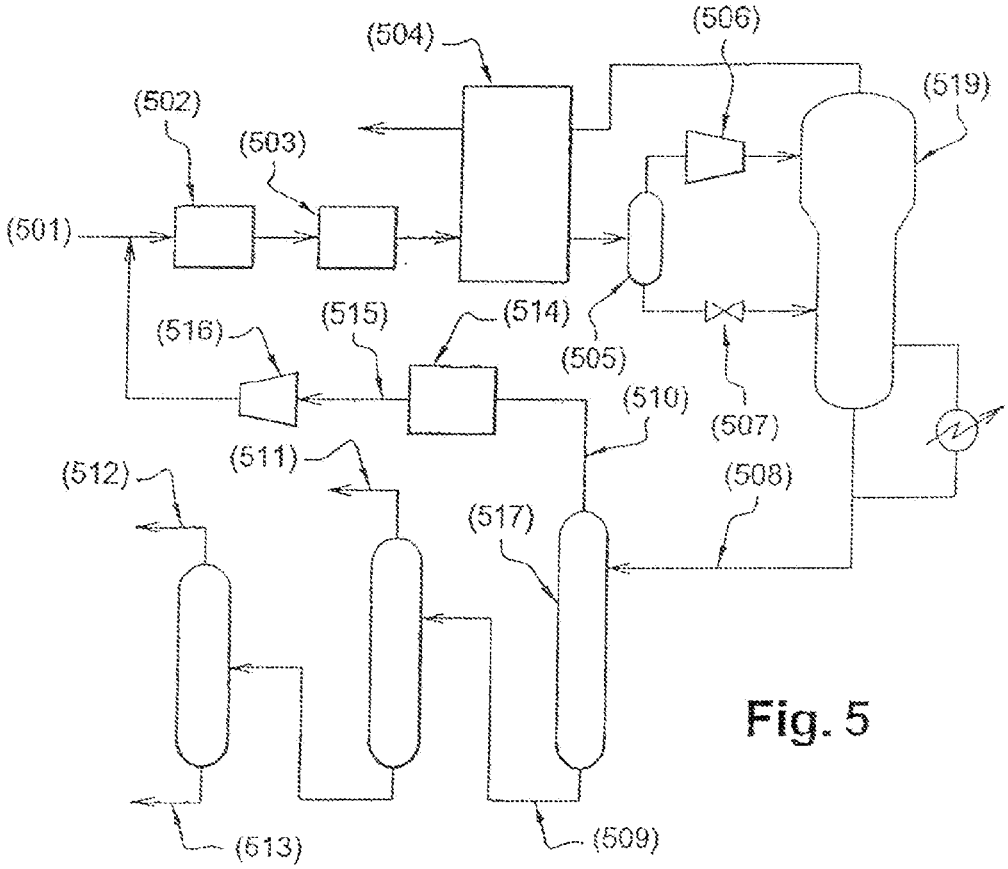
FIG. 5 shows the integration of the ethane conversion for the production of lean, non-liquefied gases using LPG extraction units.

The invention can also be used for the production of non-liquefied lean gases using LPG extraction units. An illustration of this is found in FIG. 5. The LPG extraction methods have numerous variants; however, the example described in relation to FIG. 5 can be considered to be generic.

The feed gas (501), most often loaded with $H_2S$ and $CO_2$ acid gas is deacidified in the deacidification unit (502) then dried in the unit (503). It is then cooled and partially condensed in the cryogenic exchanger (504). The liquid and the vapour are separated in the separator (505). The gas is expanded in a turbine (506) and the liquid in a valve (507). Both are fed to the column (519) where the heaviest hydrocarbons are separated from the natural gas. The purified gas is drawn off at the head and sent via the exchanger (504). The LPG-rich liquid is drawn off at the tank (508). The latter contains a part of the ethane contained in the feed gas as well as dissolved methane.

The LPG-rich methane is separated into a C3+ cut at the tank (509) of the column (517) and the top gas (510) contains ethane and methane. The liquid (509) is then separated in a standard manner into propane (511), butane (512) and condensates (513) which are then sold.

The mixture of ethane and methane (510) is introduced into the conversion unit (514) where the ethane is converted to methane. The resulting gas (515) contains carbon dioxide and water originating from the chemical reactions which take place in the conversion unit and is, after compression in (516) mixed with the feed gas (501). The carbon dioxide and the water are then eliminated together with those of the feed gas (501).

Figure 6:
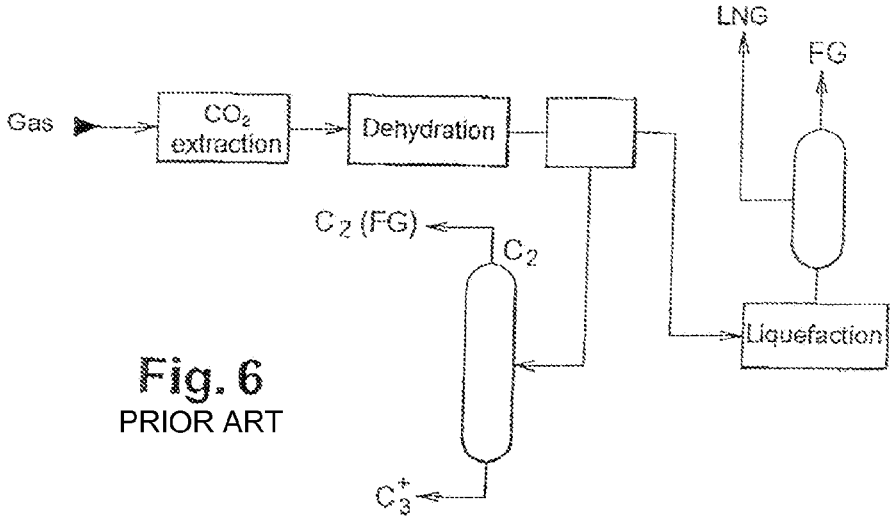
Fig. 6 PRIOR ART
FIG. 6 shows a unit according to the prior art.
Figure 7:
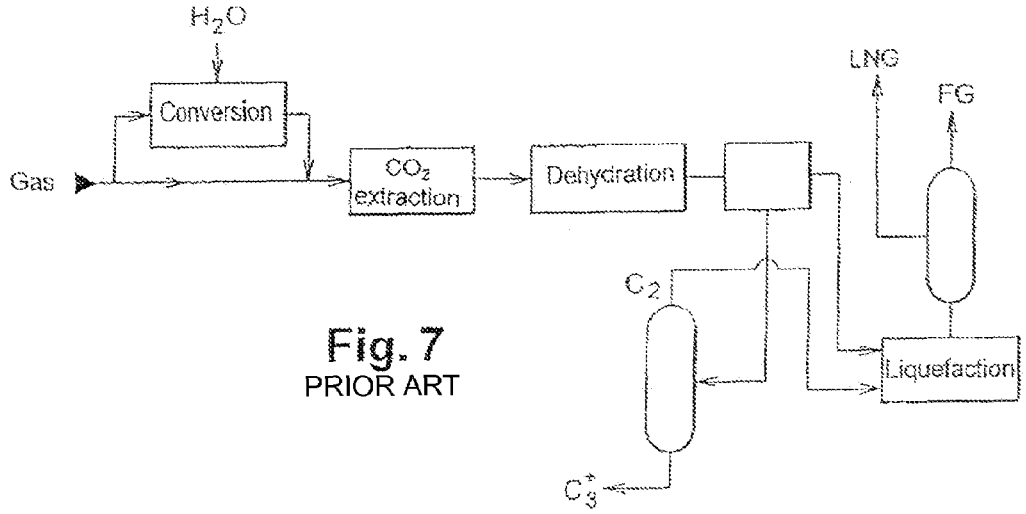
Fig. 7 PRIOR ART
FIG. 7 shows a unit as compared with the invention.
Figure 8:
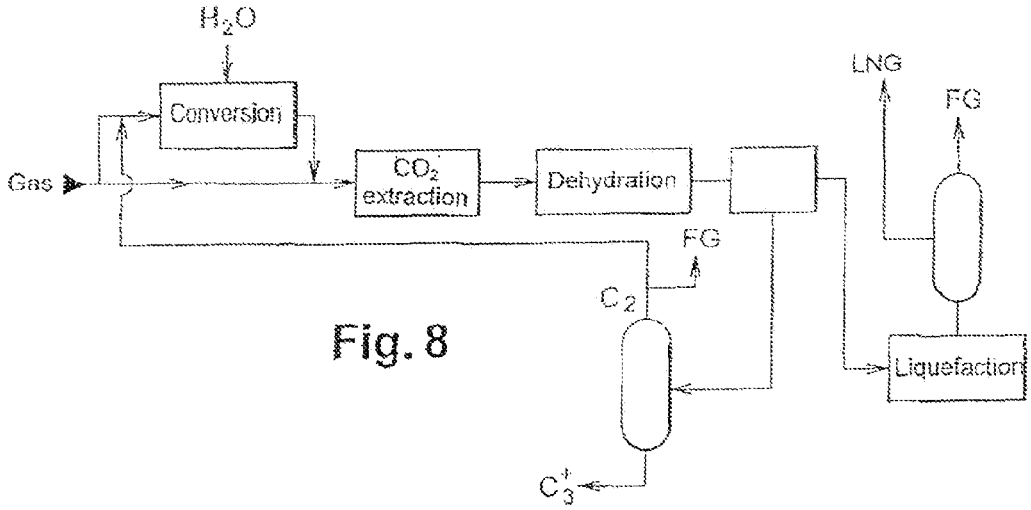
FIG. 8 shows an embodiment of the invention.
Figure 9:
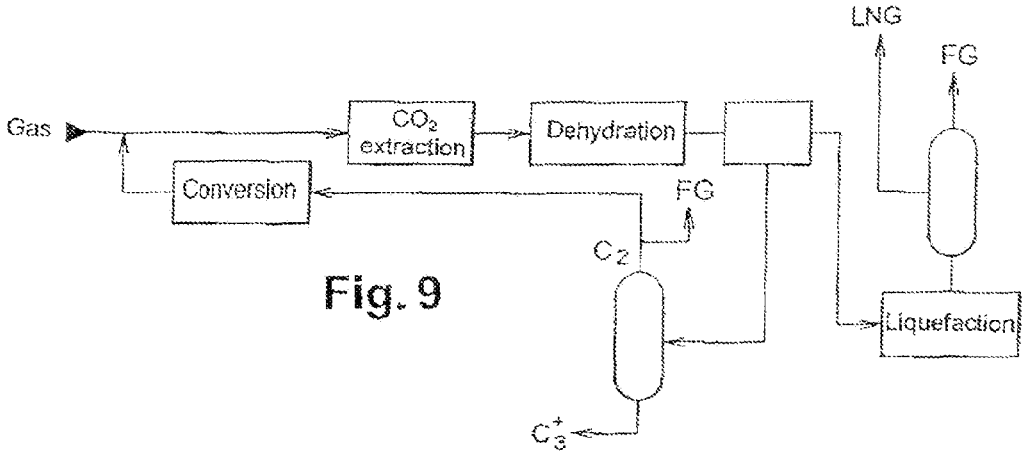
FIG. 9 shows another embodiment of the invention.

In the following, the following cases are compared:

case 1), standard liquefaction plant with fractionation, in which the stream at the deethanizer head is used as FG; this plant is represented in FIG. 6;

case 2), standard liquefaction plant comprising the stage of converting one part of the gas feed stream (approximately ⅓) and in which the stream at the deethanizer head is sent to the liquefaction unit in order to be liquefied there with the main gas stream; this plant is represented in FIG. 7;

case 3) liquefaction plant according to the invention comprising the stage of partial conversion on the gas feed stream (approximately 15%) and in which the stream at the deethanizer head is partly sent to the conversion stage and partly to the FG (approximately 60%); this plant is represented in FIG. 8;

case 4), liquefaction plant according to the invention comprising the stage of converting one part of the stream at the deethanizer head, the other part being used as FG; this plant is represented in FIG. 9.

The stream to be treated is that whose composition is shown in Table 1, the flow rate is approximately 33000 kmol/hr, and it is sought to produce a gas the HHV of which is 1075 btu/scf. Table 4 below gives the results of the different scenarios. It shows the flow rate at the level of the CRG reactor in kmol/hr, the temperature at the head of the liquefaction cycle (Tliq), the flow rate for LPG production in kmol/hr and the composition of the FG gas (in molar %).

TABLE 4

| Case | CRG (kmol/hr) | $T_{liq}$ | LPG kmol/hr | FG (%) |
|---|---|---|---|---|
| 1 | 0 | −160° C. | 716 | 9.3% $N_2$<br>36% $CH_4$<br>53% $C_2H_6$ |
| 2 | 12250 | −148° C. | 364 | 9.2% $N_2$<br>90% $CH_4$ |
| 3 | 6200 | −153° C. | 624 | 9% $N_2$<br>77% $CH_4$<br>14% $C_2H_6$ |
| 4 | 4250 | −154° C. | 833 | 10% $N_2$<br>76% $CH_4$<br>14% $C_2H_6$ |

Case 1 provides an FG gas which contains too much ethane, which makes it difficult to use in the gas turbines of the plant, unless these have dimensions such that they can accept both the natural gas upon start up of the unit and the gas with a large quantity of ethane during its nominal operation. Case 2 certainly has a high liquefaction temperature (since there is a large production of flash gas) however the flow rate imposed on the CRG reactor is too high. Cases 3 and 4 provide substantially identical FG compositions and substantially identical operating temperatures of the liquefaction plant, with a better yield of gas for case 4. The variation from case 3) to case 4) takes place by optionally sending one part of the feed stream to the treatment method according to the invention. It is possible for example to send 0% to 35% of the feed stream to the treatment method according to the invention. Similarly, the ethane stream obtained at the deethanizer head can all be sent to the methanation treatment according to the invention, or on the other hand be partially used as a fuel gas (FG) for the unit. It is thus possible to send all this ethane stream for conversion or only part of it (for example 40% as in case 3) according to the initial content of ethane in the feed gas and the maximum acceptable ethane content in the fuel gas for the gas turbines. There is a possible adjustment factor in this case. In a general manner, the ethane part sent to the conversion treatment can vary from 0 to 100%, but a range of 30 to 100% will be preferred (i.e. a utilization factor as FG of up to 70%).

It is therefore concluded that the installation of a method for conversion of ethane to methane by steam reforming and methanation of the synthesis gas allows significant gains when a given low HHV is sought.

The invention claimed is:

1. A method for treating a natural gas comprising ethane, the method comprising:

(a) extracting at least one part of the ethane from the natural gas by:

separating heavy components of the natural gas into a light fraction and a fraction of heavier components comprising ethane and Liquefied Petroleum Gases (LPGs); and fractionating the heavier components into at least one stream comprising ethane and at least one stream comprising LPGs;

(b) reforming at least one part of the extracted ethane into a synthesis gas;

(c) performing methanation of the synthesis gas into a methane-rich gas; and (d) mixing the methane-rich gas with the natural gas.

2. The method of claim 1 further comprising:

performing deacidification and drying of the natural gas before said extracting at least one part of the ethane from the natural gas, wherein said extracting at least one part of the ethane from the natural gas is carried out on sweetened and dried natural gas, wherein said mixing the methane-rich gas with the natural gas is carried out before said performing deacidification and drying of the natural gas.

3. The method of claim 1 further comprising reforming and performing methanation on one part of the natural gas before said extracting at least one part of the ethane from the natural gas.

4. The method of claim 1 further comprising using one part of the extracted ethane as fuel gas.

5. The method of claim 1 further comprising performing liquefaction of the natural gas.

6. The method of claim 1, wherein said extracting at least one part of the ethane from the natural gas is carried out on sweetened and dried natural gas; the method further comprising drying the methane-rich gas before said mixing the methane-rich gas with the natural gas.

7. The method of claim 6, wherein the sweetened and dried natural gas is available in liquefied form.

8. The method of claim 6, wherein the performing methanation of the synthesis gas into a methane-rich gas produces heat which is used for partially vaporizing the natural gas in liquefied form.

9. The method of claim 1, wherein said extracting, reforming, performing methanation, and mixing are for high heating adjustment of said natural gas.

10. A method for liquefying a natural gas comprising ethane, the method comprising:

performing deacidification and drying of the natural gas;

precooling the deacidified and dried natural gas;

extracting at least one part of the ethane from the precooled natural gas to produce a high-ethane fraction and a low-ethane fraction;

cooling and liquefying the low-ethane fraction;

separating the high-ethane fraction into a high-ethane cut and a high-propane, butane and condensates cut;

reforming at least one part of the high-ethane cut into a synthesis gas;

performing methanation of the synthesis gas into a methane-rich gas; and mixing the methane-rich gas with the natural gas before deacidification and drying.

* * * * *